US008382273B2

(12) United States Patent
Houjou

(10) Patent No.: US 8,382,273 B2
(45) Date of Patent: Feb. 26, 2013

(54) INK JET PRINTER AND METHOD OF INK JET PRINTING

(75) Inventor: Hiroaki Houjou, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 839 days.

(21) Appl. No.: 12/413,142

(22) Filed: Mar. 27, 2009

(65) Prior Publication Data

US 2009/0244236 A1 Oct. 1, 2009

(30) Foreign Application Priority Data

Mar. 28, 2008 (JP) ..... 2008-088506

(51) Int. Cl.
*B41J 2/01* (2006.01)

(52) U.S. Cl. ..... 347/102; 347/101

(58) Field of Classification Search ..... None
See application file for complete search history.

(56) References Cited

U.S. PATENT DOCUMENTS

| | | | | |
|---|---|---|---|---|
| 7,204,572 | B2 * | 4/2007 | Seki et al. | 347/16 |
| 2005/0219342 | A1 * | 10/2005 | Kachi | 347/102 |
| 2006/0214970 | A1 * | 9/2006 | Hirakawa | 347/15 |

FOREIGN PATENT DOCUMENTS

| | | | |
|---|---|---|---|
| JP | 6-134982 | A | 5/1994 |
| JP | 9-314818 | A | 12/1997 |
| JP | 2002-011860 | A | 1/2002 |
| JP | 2005-14434 | A | 1/2005 |
| JP | 2005-125750 | A | 5/2005 |
| JP | 2005-329716 | A | 12/2005 |
| JP | 2007-30201 | A | 2/2007 |

OTHER PUBLICATIONS

English translation of JP 09-314818.*

* cited by examiner

*Primary Examiner* — Matthew Luu
*Assistant Examiner* — Renee I Wilson
(74) *Attorney, Agent, or Firm* — Birch, Stewart, Kolasch & Birch, LLP

(57) ABSTRACT

An ink jet printer prints an image by ejecting ink on recording medium. Information of an ink volume of the ink for application to the recording medium, for example, dot number, is specified. A first dryer dries the recording medium before forming the image. A memory stores a data table of a relationship between the ink volume and a drive condition of the dryer. A drive condition determiner determines a drive condition of the dryer from the ink volume according to the data table read from the memory. A CPU controls the dryer in the drive condition determined by the drive condition determiner. Preferably, the drive condition determiner, if the ink volume is lower than a first tolerable amount causing occurrence of cockle on the recording medium, disables the dryer.

17 Claims, 13 Drawing Sheets

FIG. 6

81

| NUMBER OF DOTS (Xg) | $0 \leqq Xg < M1$ | $M1 \leqq Xg < M2$ | $M2 \leqq Xg$ |
|---|---|---|---|
| DRYING TEMPERATURE (°C) | 0 (WITHOUT PRE-DRYING) | T1 | T2 |

FIG. 7

82

| NUMBER OF DOTS (Xg) | $0 \leqq Xg < M1$ | $M1 \leqq Xg < M2$ | $M2 \leqq Xg$ | $M3 \leqq Xg$ |
|---|---|---|---|---|
| DRYING TEMPERATURE (°C) | 0 (WITHOUT PRE-DRYING) | T1 | T2 | T2 (WITH POST-DRYING) |

INK JET PRINTER AND METHOD OF INK JET PRINTING

BACKGROUND OF THE INVENTION

1. Field of the Invention

The present invention relates to an ink jet printer and method of ink jet printing. More particularly, the present invention relates to an ink jet printer and method of ink jet printing in which occurrence of cockle on a recording medium can be prevented.

2. Description Related to the Prior Art

An ink jet printer is an apparatus known in the field of image forming, and characterized in easily printing an image relatively inexpensively and with a somewhat simple construction. The ink jet printer is widely utilized for printing a photograph, document and the like, and for patterning a printed circuit board, producing a color filter for a display device such as a liquid crystal display panel and the like.

The ink jet printer ejects droplets of ink on to recording medium or recording sheet of paper or the like, and forms an image to produce a printed sheet obtained finally. It is necessary to evaporate the ink sufficiently after ejection to the recording medium before discharging the printed sheet. This is referred to fixation by drying. Should the printed sheet before the fixation by drying be contacted by a finger of a user's hand, a recording head, platen, roller or other mechanical elements in the ink jet printer, or other products of the printed sheet, unwanted transfer of ink occurs to degrade the printed sheet seriously. Furthermore, it is likely to cause smears on succeeding sheets of the recording medium with ink if the ink remains present on the recording head, platen, roller or the like.

Smears of ink before completing the fixation by drying are likely to occur as a considerably serious problem, because time for the fixation by drying cannot be kept during image forming in spite of recent technical development in the printing speed of the ink jet printer. There is a type of ink jet printer capable of double-sided recording in which images are printable on first and second surfaces of the recording medium. If second surface recording is started before completing the fixation by drying of a first surface, smears occur. Various documents disclose suggestion to solve this problem, including JP-A 6-134982, U.S. Pat. No. 7,204,572 (corresponding to JP-A 2005-125750), JP-A 2005-014434 and JP-A 2007-030201.

JP-A 6-134982 discloses an ink jet printer in which a length of waiting time between an end of first surface recording to a start of the second surface recording in the double-sided recording is determined by considering a type of the recording medium. In U.S. Pat. No. 7,204,572 (corresponding to JP-A 2005-125750), a frame on the first surface of the recording medium is split into a plurality of partial areas or unit regions. Information of a specified ink volume of ink, such as a dot number of dots to be recorded, is retrieved and assigned to each of the partial areas. The waiting time is determined according to the retrieved information of the specified ink volume.

In the conventional techniques, the waiting time is predetermined in consideration of severest conditions, such as a combination of art paper and an image developable with the maximum duty of printing. There are situations of very low efficiency with too long waiting time, for example, the use of a type of recording medium with a rapid drying property for ink, an image with a relatively small value of the specified ink volume. However, the suggestions in the documents described above determine the waiting time according to a type of recording medium for use or the ink volume of ink, so that an image can be recorded efficiently.

JP-A 2005-014434 discloses an ink jet printer for printing a postcard in the double-sided recording. A surface of the postcard for filling an address and name is regarded as a specific surface of which the specified ink volume is estimated lower. The first surface is used as the address surface for initially printing the address, name and the like. JP-A 2007-030201 discloses a sequence of comparing the printing duty of images between the first and second surfaces. If the printing duty of the first surface is higher than that of a second surface, the two images to be printed are exchanged with one another between the first and second surfaces. One of the two images with a smaller value of the printing duty or the ink volume can be printed earlier in the first surface recording effectively, as the waiting time required for the fixation by drying can be shorter.

In addition to the problem of smears with ink without completing the fixation by drying, occurrence of cockle or wrinkles in the printed sheet is another serious problem in the ink jet printer.

When the cockles occur, quality of the printed sheet will be lowered due to poor appearance in the printed sheet, high difficulty in the handling and other reasons. The problem of the cockles in the first surface recording in the course of the double-sided recording is specifically serious, because precision of positioning ink droplets will be low in the second surface recording, smears will occur in contact of the recording head and the recording medium, or the recording medium may jam with failure in feeding.

Cockles are created when a moisture content of the recording medium becomes higher than a tolerable amount. To be precise, cellulose fiber constituting the recording medium swells in penetration of moisture of the ink in the recording medium. The cellulose fiber comes to compress upon the fixation by drying. If the extent of the swelling of the cellulose fiber is considerably high, the cockles occur.

In JP-A 6-134982 and U.S. Pat. No. 7,204,572 (corresponding to JP-A 2005-125750), the waiting time is determined according to the type of recording medium or the specified ink volume. However, the moisture in the ink penetrates in the recording medium even in the course of the waiting time. The moisture content in the recording medium is likely to become higher than a tolerable amount. Cockles will occur remarkably in plain paper as a type of recording medium with property of high penetration, because the cellulose fiber swells considerably with the waiting time of an excessive length.

Also, a problem of occurrence of the cockles remains in JP-A 2005-014434 and JP-A 2007-030201 typically when the moisture content in the recording medium is higher than a tolerable amount, even though such documents disclose a method of a selective operation for the first surface recording with one of the surfaces in which the specified ink volume is smaller.

SUMMARY OF THE INVENTION

In view of the foregoing problems, an object of the present invention is to provide an ink jet printer and method of ink jet printing in which occurrence of cockle on a recording medium can be prevented.

In order to achieve the above and other objects and advantages of this invention, an ink jet printer for printing an image by ejecting ink on recording medium is provided. An information retriever specifies information of an ink volume of the ink for application to the recording medium. A first dryer dries the recording medium before forming the image. A memory stores a relationship between the ink volume and a drive condition of the first dryer. A drive condition determiner determines a drive condition of the first dryer from the ink volume according to the relationship read from the memory. A controller controls the first dryer in the drive condition determined by the drive condition determiner.

The memory stores the relationship for respectively a type of the recording medium or a type of the ink. The information retriever further specifies information of the type of the recording medium or the type of the ink. The drive condition determiner determines the drive condition according to at least one of the ink volume, the type of the recording medium, and the type of the ink.

The drive condition determiner, if the ink volume is lower than a first tolerable amount causing occurrence of cockle on the recording medium, disables the first dryer, and if the ink volume is equal to or higher than the first tolerable amount, determines the drive condition of the first dryer to set the first tolerable amount equal to or more than the ink volume.

Furthermore, there is a structure for image forming on first and second surfaces of the recording medium in double-sided recording. A second dryer dries the recording medium before second surface recording of the second surface after first surface recording of the first surface. The drive condition determiner and the controller further operate for determining a drive condition of the second dryer and for control thereof.

The drive condition determiner, if the ink volume is lower than an increased level of the first tolerable amount set by the first dryer, disables the second dryer, and if the ink volume is equal to or higher than the increased level of the first tolerable amount set by the first dryer, determines a drive condition of the second dryer to set a penetration amount of the ink in the recording medium equal to or lower than the increased level of the first tolerable amount.

Furthermore, there is a waiting device for waiting of the recording medium after the first surface recording before the second surface recording. The drive condition determiner and the controller further operate for determining a drive condition of the waiting device and for control thereof.

If the ink volume is lower than a second tolerable amount short of sufficient drying within a predetermined time, or if an estimated value of a penetration amount of the ink in the recording medium during waiting is found to become equal to or higher than an increased level of the first tolerable amount set by the first dryer, then the drive condition determiner determines a drive condition of the second dryer to set the penetration amount equal to or lower than the increased level of the first tolerable amount without driving the waiting device. If the ink volume is equal to or higher than the second tolerable amount, and if the estimated value of the penetration amount during waiting is found to become lower than the increased level of the first tolerable amount set by the first dryer, then the drive condition determiner determines a drive condition of the waiting device to set the penetration amount lower than the second tolerable amount.

The information retriever specifies information of the ink volume for unit regions defined by splitting a frame on the recording medium, and the drive condition determiner determines the drive condition for each of the unit regions.

The unit regions are arranged two-dimensionally with reference to a main scanning direction and a sub scanning direction of image forming.

The first dryer includes plural heating elements having a size substantially equal to a size of the unit regions, arranged in the main scanning direction, and conditioned discretely in the drive condition.

Furthermore, a changer changes a unit region designated for drying with the first dryer among the unit regions.

The changer shifts the first dryer in a main scanning direction.

The changer is a mechanism for rotationally shifting the first dryer to change the unit region designated for drying.

In one aspect of the invention, an ink jet printing method of printing an image by ejecting ink on recording medium is provided, and includes a step of specifying information of an ink volume of the ink for application to the recording medium. A drive condition of a first dryer is determined from the ink volume according to a relationship between the ink volume and a drive condition of the first dryer. In a first drying step, the recording medium is dried in the first dryer before forming the image in the drive condition determined by the drive condition determining step.

If the ink volume is lower than a first tolerable amount causing occurrence of cockle on the recording medium, the first drying step is suppressed. If the ink volume is equal to or higher than the first tolerable amount, the first drying step is carried out and sets the first tolerable amount equal to or higher than the ink volume.

Furthermore, there is a second drying step of drying the recording medium in a second dryer before second surface recording to a second surface in a sequence of double-sided recording of successive image forming to a first surface and the second surface.

If the ink volume is lower than an increased level of the first tolerable amount set by the first drying step, the second drying step is suppressed, and if the ink volume is equal to or higher than the increased level of the first tolerable amount set by the first drying step, the second drying step is carried out to set a penetration amount of the ink in the recording medium equal to or lower than the increased level of the first tolerable amount.

Furthermore, there is a step of waiting of the recording medium before the second surface recording to dry the ink on the first surface.

If the ink volume is lower than a second tolerable amount short of sufficient drying within a predetermined time, or if an estimated value of a penetration amount of the ink in the recording medium during waiting is found to become equal to or higher than an increased level of the first tolerable amount set by the first drying step, then the second drying step is carried out to set the penetration amount equal to or lower than the increased level of the first tolerable amount by suppression of the waiting step. If the ink volume is equal to or higher than the second tolerable amount, and if the estimated value of the penetration amount during waiting is found to become lower than the increased level of the first tolerable amount set by the first drying step, then the waiting step is carried out to set the penetration amount lower than the increased level of the second tolerable amount.

In another aspect of the invention, a computer executable program for ink jet printing method of printing an image by ejecting ink on recording medium is provided, and includes a program code for specifying information of an ink volume of the ink for application to the recording medium. A program code is for determining a drive condition of a first dryer from the ink volume according to a relationship between the ink volume and a drive condition of the first dryer. A program code is for drying the recording medium in the first dryer before forming the image in the drive condition determined by the drive condition determining program code.

Accordingly, occurrence of cockle on a recording medium can be prevented, owing to the sequence of considering a specified ink volume before printing.

BRIEF DESCRIPTION OF THE DRAWINGS

The above objects and advantages of the present invention will become more apparent from the following detailed description when read in connection with the accompanying drawings, in which:

FIG. 6 is a table illustrating a single-sided recording data table;

FIG. 7 is a table illustrating a double-sided recording data table;

DETAILED DESCRIPTION OF THE PREFERRED EMBODIMENT(S) OF THE PRESENT INVENTION

Figure 1:
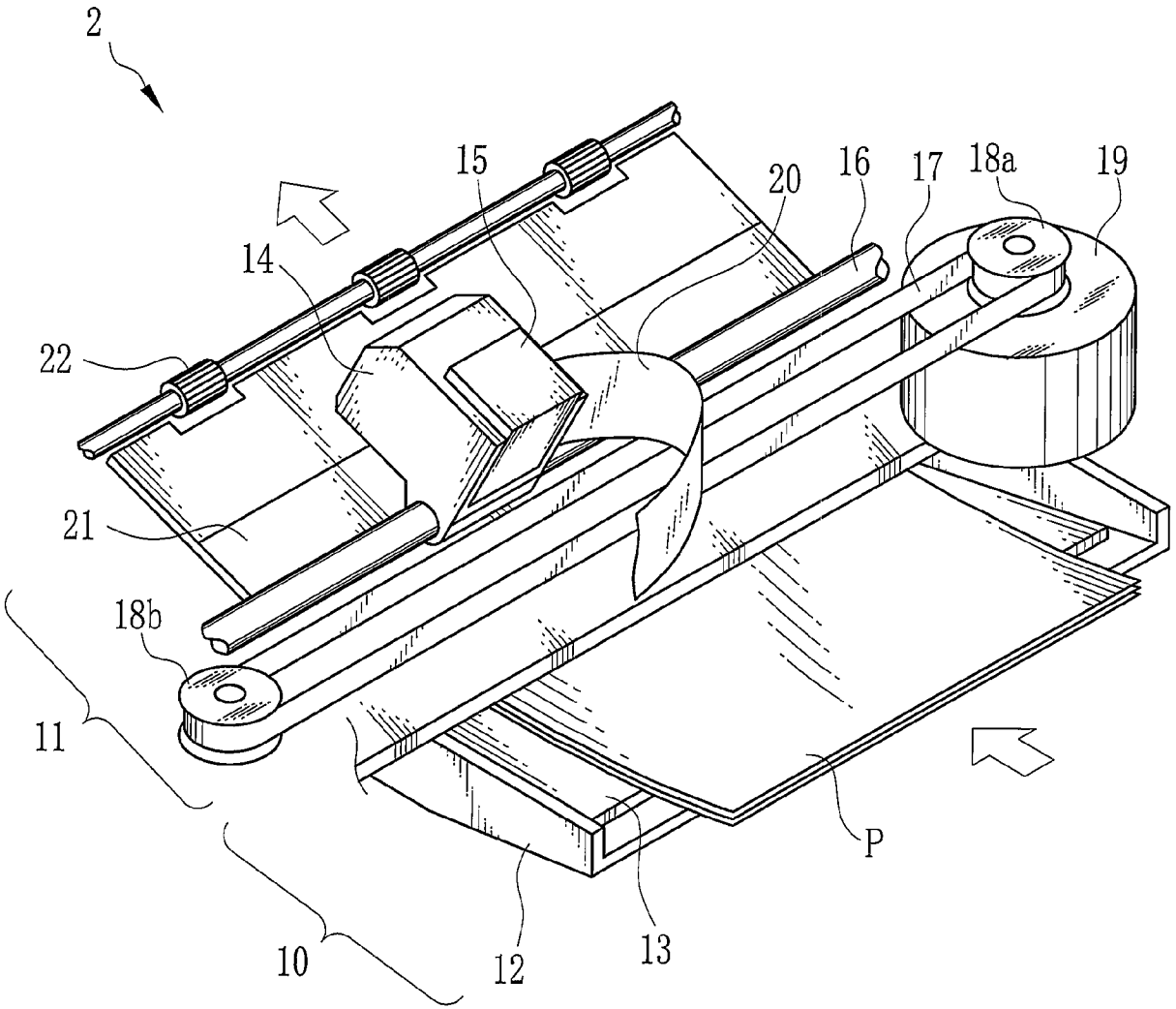
FIG. 1 is a perspective view illustrating an ink jet printer.

In FIG. 1, an ink jet printer 2 includes a sheet feeder 10 and an image forming device 11. The sheet feeder 10 supplies recording media P. The image forming device 11 records an image on each of the recording media P. The sheet feeder 10 includes a base plate 12 and a pressure plate 13 supported on the base plate 12 in a rotatable manner. The plural recording media P are placed on the pressure plate 13. Also, the sheet feeder 10 includes a pickup roller 31 and a separation pad 32 of FIG. 2.

A carriage 14 is incorporated in the image forming device 11. A recording head 15 or printhead of a cartridge form is secured to the carriage 14 in a removable manner. The recording head 15 is an array of ink ejecting nozzles for ejecting inks of plural colors to the recording medium P, the colors including cyan, magenta, yellow and black. A guide shaft 16 supports the carriage 14 in a slidable manner in a main scanning direction. A drive belt 17 is partially attached to the carriage 14 for transmission. A pair of pulleys 18*a* and 18*b* are arranged in the main scanning direction for turning the drive belt 17. A carriage motor 19 is axially connected with the pulley 18*a* for rotation. The carriage 14 is moved back and forth in the main scanning direction by the drive belt 17 circulating when the carriage motor 19 is driven.

One end of a flexible cable 20 is connected with the carriage 14. A second end of the cable 20 is connected with a head driver 66 of FIG. 3. The cable 20 has such a length and flexibility as to allow the carriage 14 to move in the main scanning direction. The cable 20 transmits a drive signal from the head driver 66 to the recording head 15. Ink ejecting nozzles of the recording head 15 eject droplets of ink in response to the drive signal.

Figure 2:
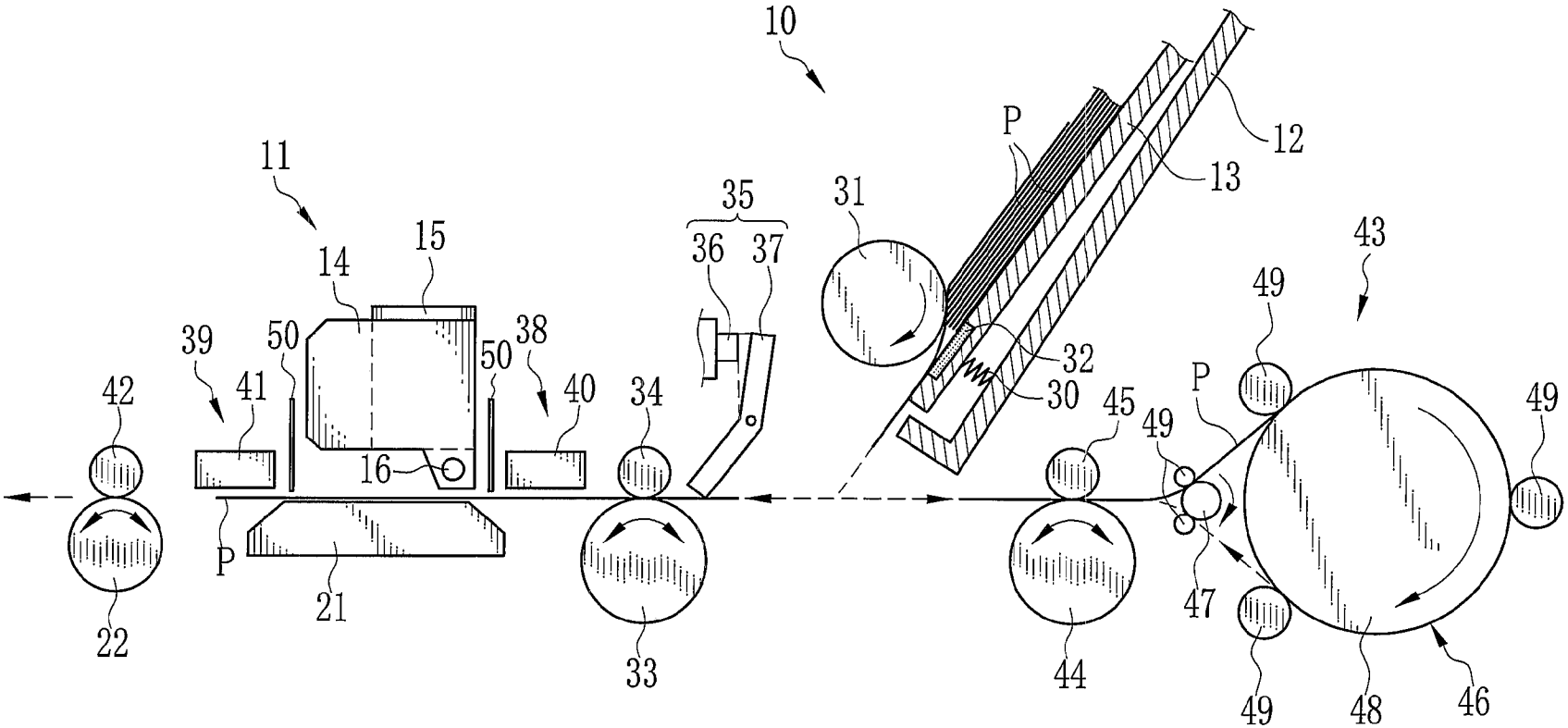
FIG. 2 is a side elevation illustrating mechanical elements of the ink jet printer.

A supply roller 33 moves the recording medium P of FIG. 2. In the image forming device 11, a platen 21 supports the recording medium P. A discharge roller 22 and a spur or pinch roller 42 squeeze the recording medium P on the platen 21. A conveyor motor 69 of FIG. 3 drives the discharge roller 22 to move the recording medium P in a sub scanning direction which is indicated by the arrow of the broken line. While the recording medium P moves in the sub scanning direction, the carriage 14 moves in the main scanning direction to eject droplets of ink through the recording head 15. An image is formed on the recording medium P.

In FIG. 2, components for moving the recording medium P are illustrated. A spring 30 on the base plate 12 biases the pressure plate 13 of the sheet feeder 10 toward the pickup roller 31. The separation pad 32 is secured to the pressure plate 13 and opposed to the pickup roller 31. Material of the separation pad 32 is polyurethane foam or the like which have a high coefficient of friction in contact with the recording medium P. Friction of the separation pad 32 keeps lower media among the recording media P immovable on the pickup roller 31.

The pickup roller 31 is a roller of rubber or other elastic material. The pickup roller 31 is caused by the conveyor motor 69 to rotate forwards for moving the recording medium P toward the discharge roller 22. With friction of the pickup roller 31 in rotation and the retention of the separation pad 32, an uppermost one of the recording media P on the pressure plate 13 is supplied toward the image forming device 11 one after another.

A pinch roller 34 is opposed to the supply roller 33 for tight contact. The supply roller 33 is caused by the conveyor motor 69 to rotate in a forward direction and a backward direction. The supply roller 33 in cooperation with the pinch roller 34 rotates forwards to move the recording medium P from the pickup roller 31 toward the platen 21. For the double-sided recording, the supply roller 33 rotates backwards. A reverse feeding device 43 is supplied by the supply roller 33 with the recording medium P from the discharge roller 22 after first surface recording.

An edge detector 35 for detecting a sheet end is positioned upstream from the supply roller 33 and the pinch roller 34. The edge detector 35 includes an edge sensor 36 and a detection lever 37. The detection lever 37 is disposed in a rotatable manner about its pivot. While the recording medium P is not present in the image forming device 11, an upper end of the detection lever 37 contacts the edge sensor 36 as indicated by the broken line. When the recording medium P enters the image forming device 11, a lower end of the detection lever 37 is lifted by the recording medium P rotationally in the clockwise direction. The upper end of the detection lever 37 moves away from the edge sensor 36 as indicated by the solid line. The edge sensor 36 checks a contacted state of the upper end of the detection lever 37, to detect presence or absence of the recording medium P in the image forming device 11.

A first dryer 38 and a second dryer 39 are so disposed that the recording head 15 lies between those. The first and second dryers 38 and 39 are equally constructed, and have respectively infrared heaters 40 and 41. Water in the recording medium P, which may be previously contained in the same or applied in the image forming by use of the ink, is evaporated by heating of the infrared heaters 40 and 41 without contact. The first dryer 38 dries the unused recording medium P moved from the sheet feeder 10 to the image forming device 11. This step is referred to as pre-drying.

The second dryer 39 dries the recording medium P after the double-sided recording. This is subsequent drying.

The discharge roller 22 and the pinch roller 42 are positioned downstream from the second dryer 39. The pinch roller 42 is pressed against the discharge roller 22. The discharge roller 22 is caused by the conveyor motor 69 to rotate back and forth in a manner similar to the supply roller 33. The discharge roller 22 cooperates with the pinch roller 42 and discharges the recording medium P to a discharge tray (not shown) after image forming with the recording head 15.

The reverse feeding device 43 is disposed on a side upstream from the sheet feeder 10. The reverse feeding device 43 includes a reverse feed roller 44, a pinch roller 45 and a roller assembly 46 having plural rollers. The reverse feed roller 44 is rotated back and forth by the conveyor motor 69 in a manner similar to the discharge roller 22 and the supply roller 33. The reverse feed roller 44 cooperates with the pinch roller 45 for the double-sided recording to move the recording medium P toward the roller assembly 46 after the first surface recording from the supply roller 33. Also, the reverse feed roller 44 moves the recording medium P after turning over with the roller assembly 46.

The roller assembly 46 includes a small intermediate roller 47, a large end roller 48 and pinch rollers 49, and defines a loop-shaped path for reversing. The small intermediate roller 47 and the large end roller 48 are caused by the conveyor motor 69 to rotate in the forward direction. The pinch rollers 49 cooperate with the small intermediate roller 47 and the large end roller 48, which turn over the recording medium P after the first surface recording from the reverse feed roller 44, and then move back the same to the reverse feed roller 44.

In the double-sided recording, the discharge roller 22 and the supply roller 33 are changed over for backward rotation after image forming on a first surface of the recording medium P. The discharge roller 22 and the supply roller 33 move the recording medium P from the discharge tray in an upstream direction and then toward the reverse feeding device 43. The recording medium P in the reverse feeding device 43 is introduced in the roller assembly 46 by the reverse feed roller 44, passed in a loop-shaped path in the roller assembly 46, and reversed front to back. Then the recording medium P is moved again to the position of the recording head 15 by the reverse feed roller 44 and the supply roller 33 which are driven for the forward rotation, and is processed for recording an image.

Note that heat from the first and second dryers 38 and 39 may lower the performance of keeping ink in the nozzles in the recording head 15, and lower the performance of ink ejection, because the first and second dryers 38 and 39 are considerably near to the recording head 15. In view of this, heat insulators 50 are disposed between the recording head 15 and the first and second dryers 38 and 39 to prevent transmission of heat to the recording head 15.

Figure 3:
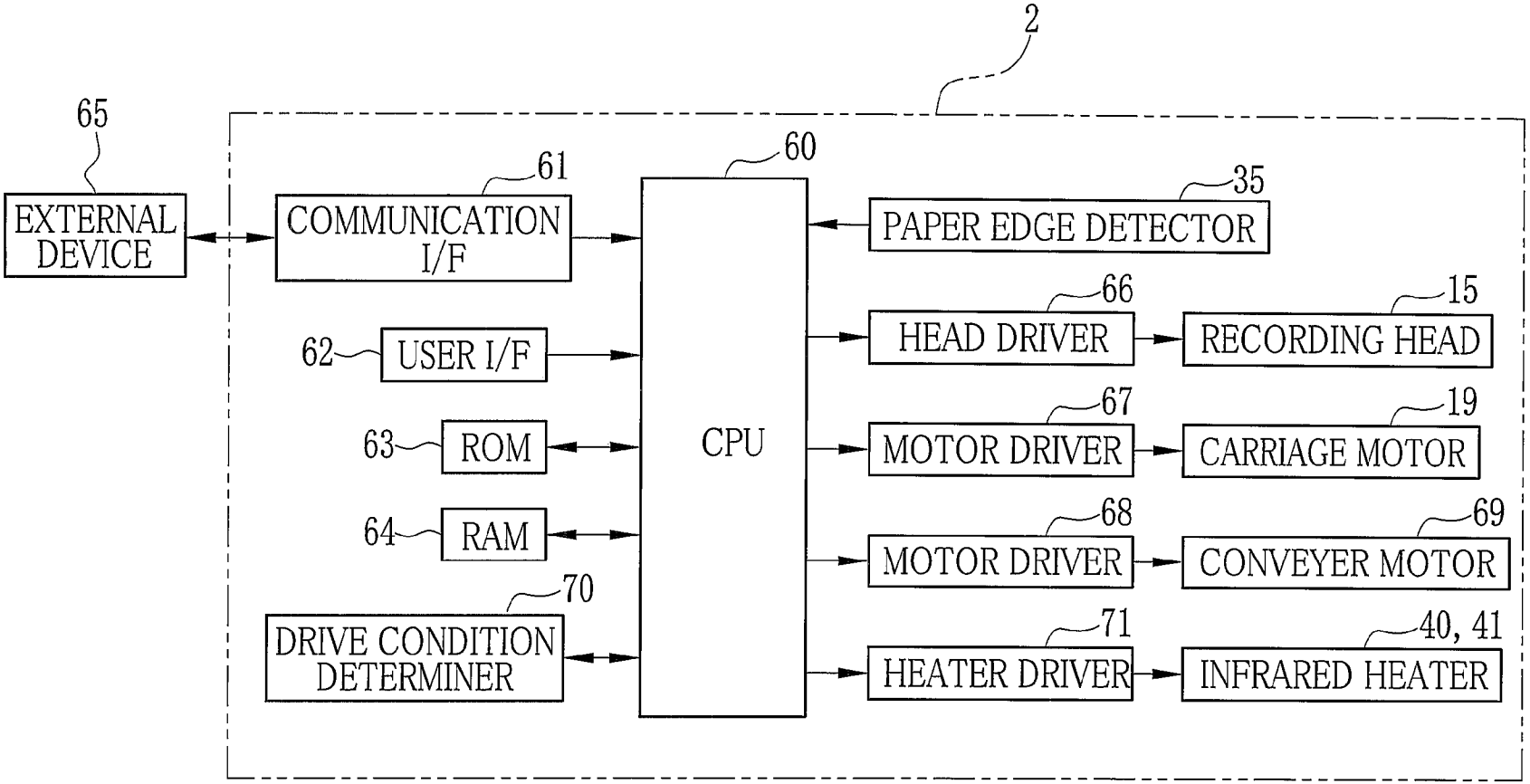
FIG. 3 is a block diagram schematically illustrating circuit elements of the ink jet printer.

In FIG. 3, a CPU 60 controls various circuit elements in the ink jet printer 2. To the CPU 60 are connected a communication interface 61, a user interface 62, a ROM 63 and a RAM 64.

An external device 65, such as a personal computer and other electronic devices, is connected with the communication interface 61. Data for image recording is input by the external device 65 to the CPU 60 through the communication interface 61.

The user interface 62 includes input devices such as buttons, cross-shaped keys, ten-key panel and the like, and output devices such as a liquid crystal display panel, LEDs and the like for indication. Various data are input to the CPU 60 by operating the input devices. The output devices display information of states of the ink jet printer 2 visibly, such as an idle state, active state, stopped state after occurrence of an error, and the like. The CPU 60 transmits the information of the states of the ink jet printer 2 to the external device 65 successively through the communication interface 61.

The ROM 63 is a non-volatile memory, such as flash memory, capable of rewriting data. The ROM 63 stores a control program for operating the ink jet printer 2, profile data, manually set data input with the user interface 62, specifically a single-sided recording data table 81 and a double-sided recording data table 82 of FIGS. 6 and 7. The CPU 60 reads the program and data from the ROM 63 for control of various devices.

The RAM 64 is a volatile memory, such as SDRAM, capable of reading and writing at high speed. Data or raster data is input by the external device 65 and written to the RAM 64. The CPU 60 reads the raster data from the RAM 64. The CPU 60 converts the raster data into printing image data for the purpose of recording with the recording head 15, and writes the printing image data to the RAM 64.

The CPU 60 outputs the printing image data to the head driver 66, the printing image data being stored in the RAM 64. The head driver 66 converts the printing image data into a drive signal, which is applied to the recording head 15 to eject droplets of ink. Also, motor drivers 67 and 68 are controlled by the CPU 60 to drive the carriage motor 19 and the conveyor motor 69.

In the CPU 60, the control program read from the ROM 63 is run. Various circuit elements for functions operate. The circuit elements include a cleaning control unit, an error checker, an alarm unit and the like. The cleaning control unit controls cleaning of a surface of the pickup roller 31 or the like. The error checker detects an error in the sheet feeding according to information of detection of the recording medium P from the edge detector 35, such as jam or the like. The alarm unit generates alarm information to indicate on the user interface for alarm of cleaning when the number of times of detection of the error becomes equal to or more than a reference number of times.

A drive condition determiner 70 operates by running the control program read from the ROM 63, and determines a drive condition for the first and second dryers 38 and 39. The drive condition determiner 70 reads printing image data from the RAM 64, and arithmetically specifies a total ink volume of the ink for use in unit regions T or partial areas according to the printing image data by way of an information retriever. The unit regions T are defined by splitting the surface of the recording medium P.

Figure 4:
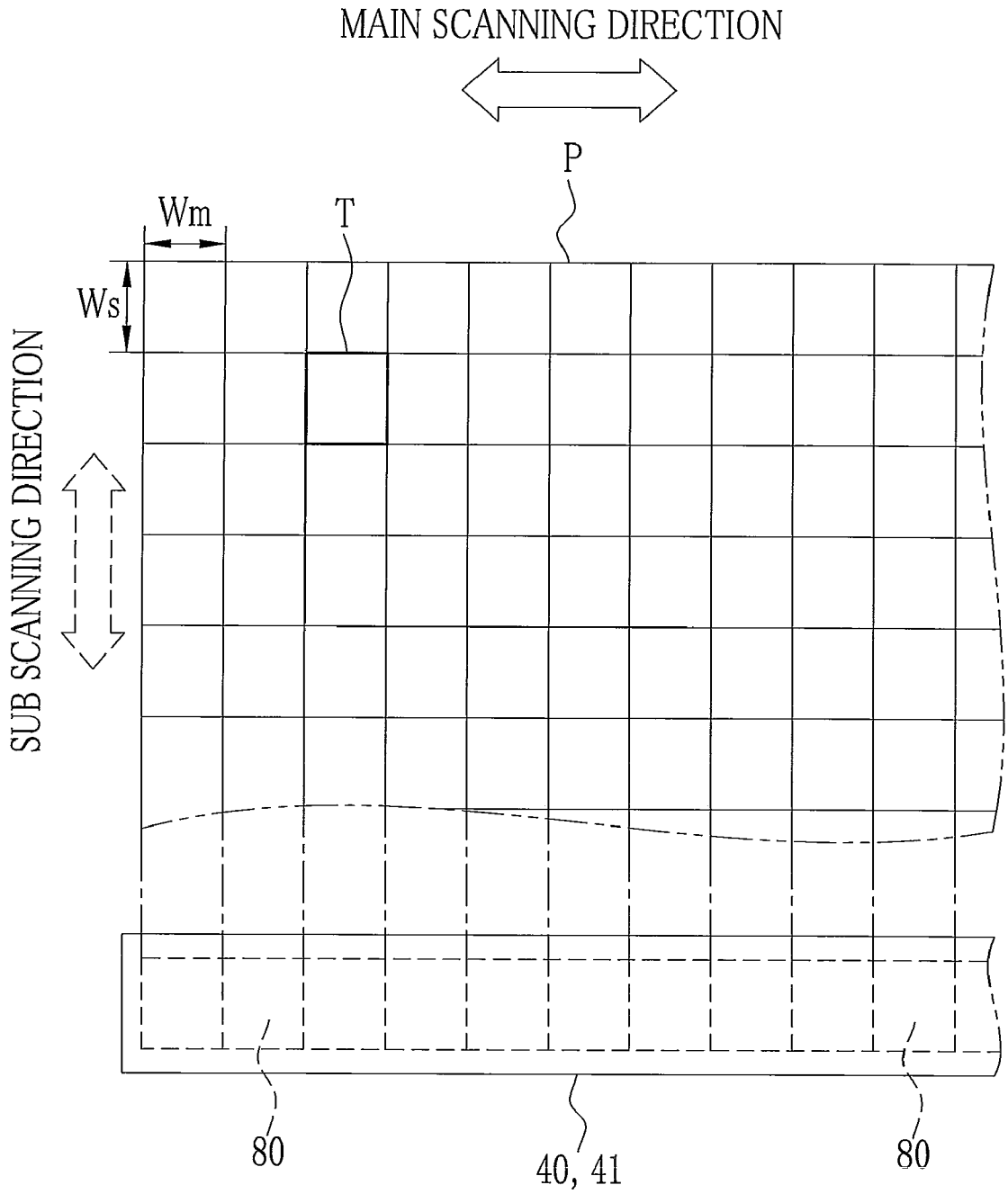
FIG. 4 is an explanatory view in a plan illustrating unit regions and an infrared heater.

In FIG. 4, the unit regions T are single quadrilaterals defined on the surface of the recording medium P by virtually drawing numerous lines in the main and sub scanning directions and in an equidistant form. Each of the unit regions T has a width Wm in the main scanning direction equal to 100 dots, and a length Ws in the sub scanning direction equal to 160 dots. Note that a dimension of the unit regions T may be modified suitably in consideration of the precision of arithmetically specifying the total ink volume, and process time for specifying the total ink volume.

In a lower portion of FIG. 4, heating elements 80 are arranged in the main scanning direction and constitute an array in each of the infrared heaters 40 and 41 in the first and second dryers 38 and 39. The heating elements 80 have a form substantially equal to a unit region T, and are as many as the unit regions T in relation to the main scanning direction. A heater driver 71 of FIG. 3 drives the heating elements 80 discretely. Power applied to the heating elements 80, namely heat energy for those to generate, is changeable with the heater driver 71 in a range from zero (0) to the maximum instantaneously and stepwise.

Figure 5:
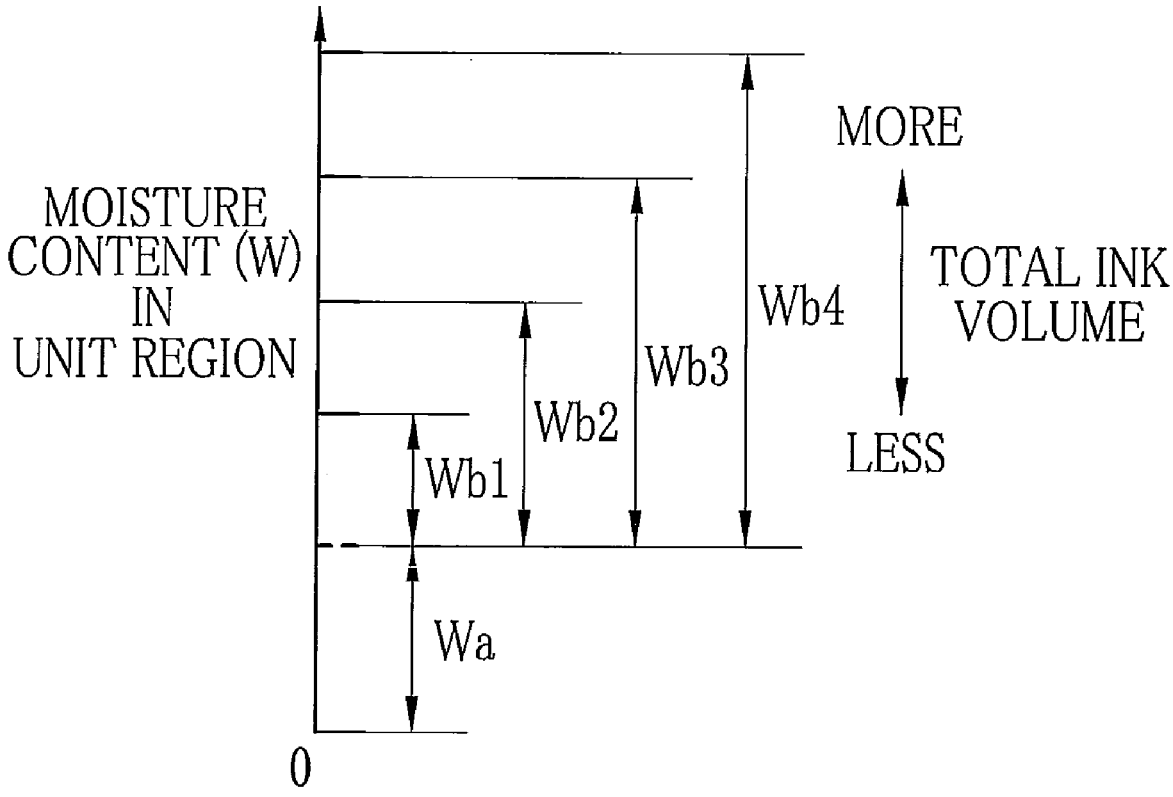
FIG. 5 is a graph illustrating a moisture content in the unit regions.

If there are one type of the recording media P and one type of ink, and if the ink deposited by the recording head 15 penetrates in the surface of the recording medium P, the moisture content W of the unit region T after the ink application is defined as a sum of the moisture content Wa maintained in the recording medium P before the recording with humidity or the like, and the moisture content Wb derived from the ink, more precisely, ink solvent in solution of pigment, dye or the like as the ink. See FIG. 5. Therefore, the moisture content W in the unit region T after the ink application increases according to an increase in the total ink volume. In the drawing, moisture contents Wb1 to Wb4 are illustrated as steps of the moisture content Wb.

When water in the ink penetrates in the recording medium P, cellulose fiber inside the sheet swells. When the ink is dried and fixed by evaporation of its solvent, the cellulose fiber compresses. According to the degree of swelling of the cellulose fiber, wrinkles or cockles occur on the surface of the recording medium P. In view of this, the drive condition determiner 70 determines a drive condition of the first and second dryers 38 and 39 so as to prevent cockles.

Specifically, examples of the total ink volume for one unit region T can be the number of dots (hereinafter referred to as printing dot number Xg or dot count) for recording in the unit region T, ratio of the number of dots, or such values indirectly expressing the total ink volume, or the total ink volume itself determined arithmetically according to the dot number Xg or its ratio. The ratio of the dot number Xg is a quotient of division of the dot number Xg by the highest dot number of dots recordable in the unit region T, which is 16,000=100×160. The ratio of the dot number Xg is 0% if nothing is recorded in a unit region T, and is 100% if a portion of an image developable with the maximum duty of printing is recorded in the unit region T. In the embodiment, the dot number Xg is used as the total ink volume.

For the single-sided recording, the drive condition determiner 70 reads the single-sided recording data table 81 of FIG. 6 from the ROM 63. The single-sided recording data table 81 is a table of a relationship between the dot number Xg and a drive condition of the first dryer 38, namely a drying temperature (deg. C.) of the heating elements 80. Specifically, the drying temperature is determined as follows.

If $0 \leqq Xg < M1$, the drying temperature is 0 (deg. C.), namely without pre-drying.

If $M1 \leqq Xg < M2$, the drying temperature is T1 (deg. C.).

If $M2 \leqq Xg$, the drying temperature is T2 (deg. C.).

The drying temperature as a term used herein means the temperature of the heating elements 80 themselves, or the temperature of the unit regions T heated by their heat energy.

For the double-sided recording, the drive condition determiner 70 reads the double-sided recording data table 82 of FIG. 7 from the ROM 63. The double-sided recording data table 82 is constituted by a relationship between the dot number Xg of dots and the drying temperature (deg. C.) according to the heating elements 80. Also, a data table related to the drive condition for the second dryer 39 is stored. The double-sided recording data table 82 is equal to the single-sided recording data table 81 if the dot number Xg satisfies the condition of $0 \leqq Xg < M1$ or $M1 \leqq Xg < M2$. The drying temperature is conditioned at T2 (deg. C.) if $M2 \leqq Xg < M3$. Also, the drying temperature (subsequent drying) is conditioned at T2 if $M3 \leqq Xg$.

M1, M2 and M3 satisfy the condition of $0 < M1 < M2 < M3$. T1 and T2 satisfy the condition of $0 < T1 < T2$. As the moving speed of the recording medium P is constant, heat energy for drying the unit regions T must be high according to highness of the dot number Xg which is the total ink volume. Thus, the drying temperature for the dot number Xg is determined high according to the highness of the dot number Xg, which has been heretofore described.

M1 is a first tolerable amount of the dot number Xg (total ink volume) with which cockles occur without the step of the pre-drying. In the embodiment, M1 is determined at such a value that the degree of cockles (for example height of corrugation) becomes intolerable in the unit regions T in the second surface recording, assuming that the second surface recording is immediately started after the end of the first surface recording. T2 is a tolerable highest temperature for the recording medium P. Thus, M3 is a highest value of the first tolerable amount available by an increase with the first dryer 38. The values M1-M3 and T1 and T2 are specified by conducting experiments.

If the dot number Xg is lower than M1 ($Xg < M1$), then very few cockles occur in the unit regions T in the course of the second surface recording. Then it is possible not to carry out the pre-drying for each one of the unit regions T where $0 \leqq Xg < M1$. In contrast, if the dot number Xg is equal to or higher than M1 ($Xg \geqq M1$), then apparent cockles occur to influence to the quality in the course of the second surface recording. Then the pre-drying is carried out at the drying temperature T1 (if $M1 \leqq Xg < M2$) or at the drying temperature T2 (if $M2 \leqq Xg < M3$), for the dot number $Xg \geqq M1$.

Figure 8:
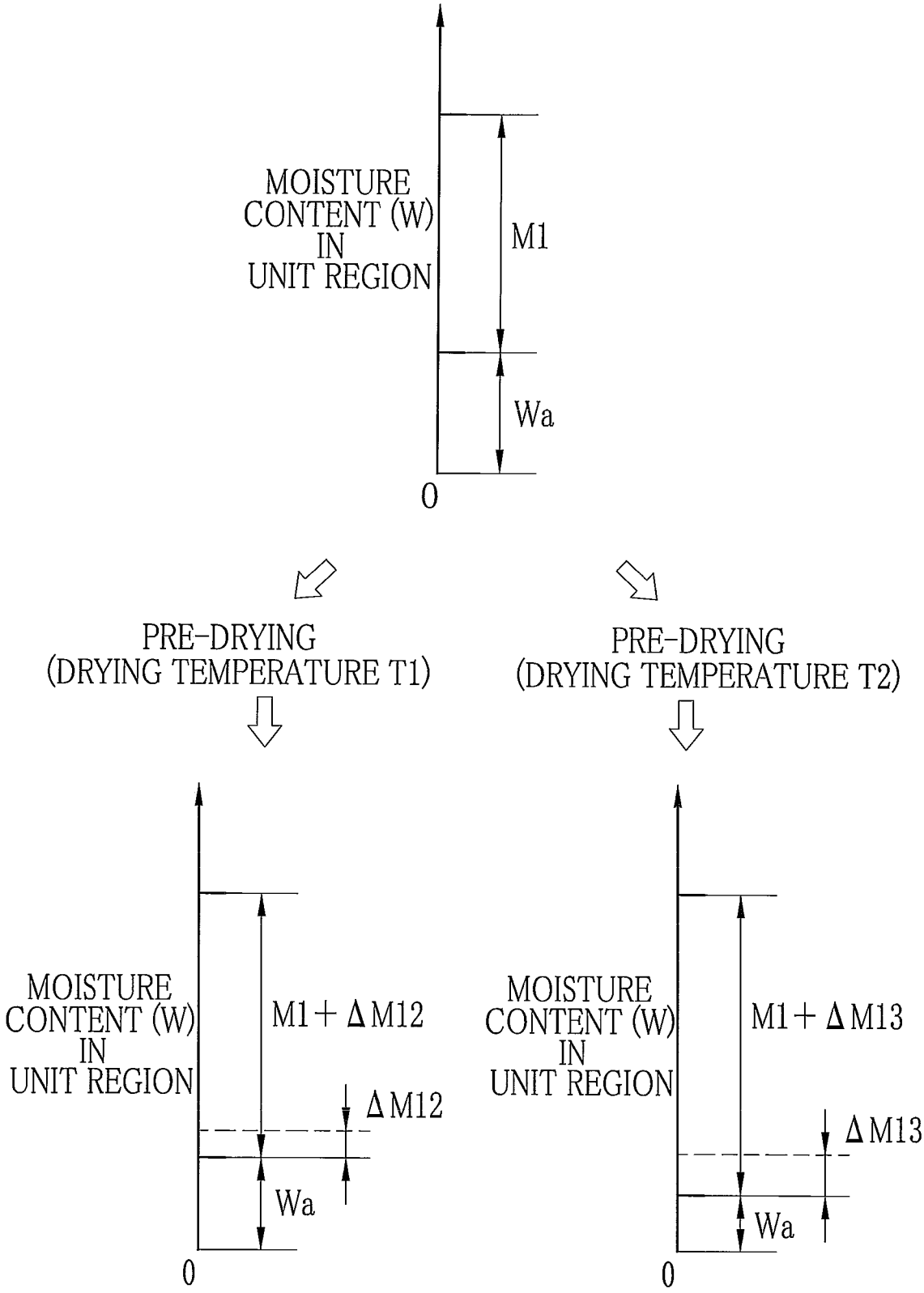
FIG. 8 is an explanatory view with combined graphs illustrating changes in a moisture content in unit regions.

The pre-drying evaporates water of the moisture content Wa in the unit region T due to moisture before image forming. Thus, the first tolerable amount is raised. In FIG. 8, the first tolerable amount without the pre-drying is M1. When the pre-drying is carried out, the moisture content Wa in the unit region T decreases by ΔM12 (for the drying temperature T1) or ΔM13 (for the drying temperature T2). Thus, the first tolerable amount becomes as high as M1+ΔM12 or M1+ΔM13. Those are the possible highest levels of the first tolerable amount by means of the drying temperatures T1 and T2. In short, M1+ΔM12 corresponds to M2, and M1+ΔM13 corresponds to M3. Note that a relationship of $\Delta M12 < \Delta M13 < Wa$ is established between Wa, ΔM12 and ΔM13.

If the dot number Xg is equal to or more than M3 ($M3 \leqq Xg$) as first tolerable amount available by operation of the first dryer 38, cockles will occur even after the step of the pre-drying at the drying temperature T2. Therefore, in the case of $M3 \leqq Xg$, the pre-drying at the drying temperature T2 is carried out before the subsequent drying is carried out.

Specific steps of the subsequent drying are different from those of the pre-drying. This is because the subsequent drying is carried out after ink application in the unit regions T. The amount of the penetration of the ink must be considered as well as the total ink volume.

Figure 9:
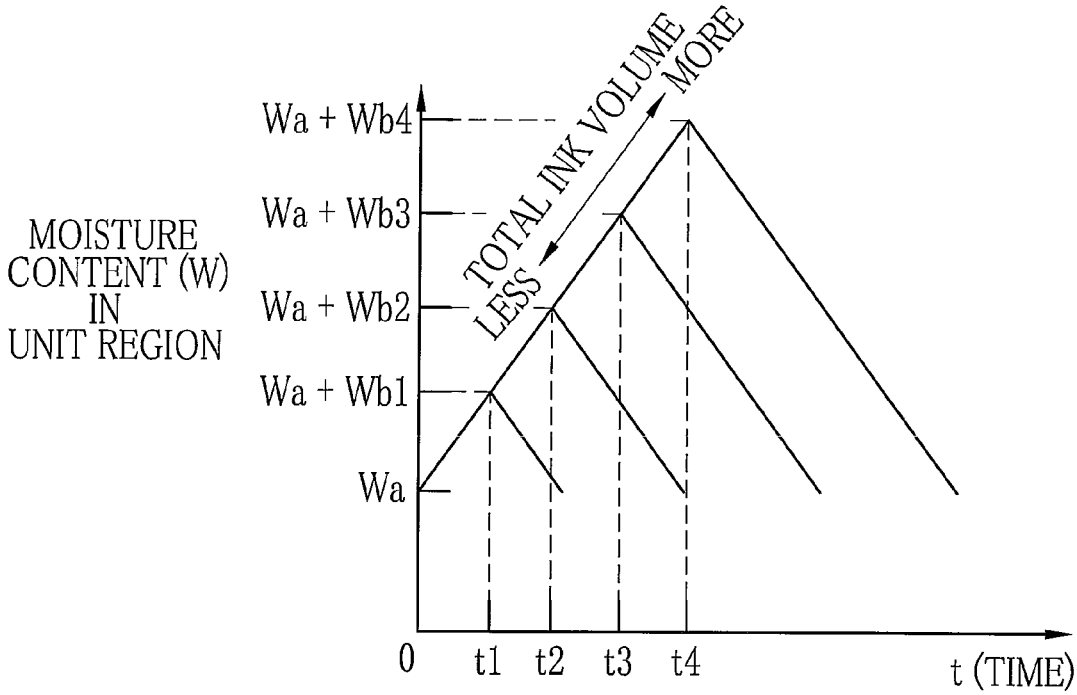
FIG. 9 is a graph illustrating a relationship between a moisture content in unit regions and time.

In FIG. 9, a relationship between the moisture content W in one of the unit regions T and the time is depicted. Let 0 be a time point when ink is ejected to the unit region T. The moisture content W in the unit region T at the time 0 is only the moisture content Wa contained previously with moisture or the like. When time elapses after the ink application, water in the ink penetrates in the unit region T to increase its moisture content W. At the time t1, all water of the moisture content Wb1 in the ink penetrates in the unit region T, to maximize the moisture content W=Wa+Wb1. As water of the moisture content Wb1 evaporates in the atmosphere, the moisture content W decreases in the unit region T. A length of a period until the time t1 at the peak of the moisture content W in the unit region T is greater according to the total ink volume. Note that the form of the FIG. 9 is schematic for the purpose of clarification, and substantially different from the actual form. Four time points t1 to t4 of peaks are illustrated in correspondence with FIG. 5.

Figure 10:
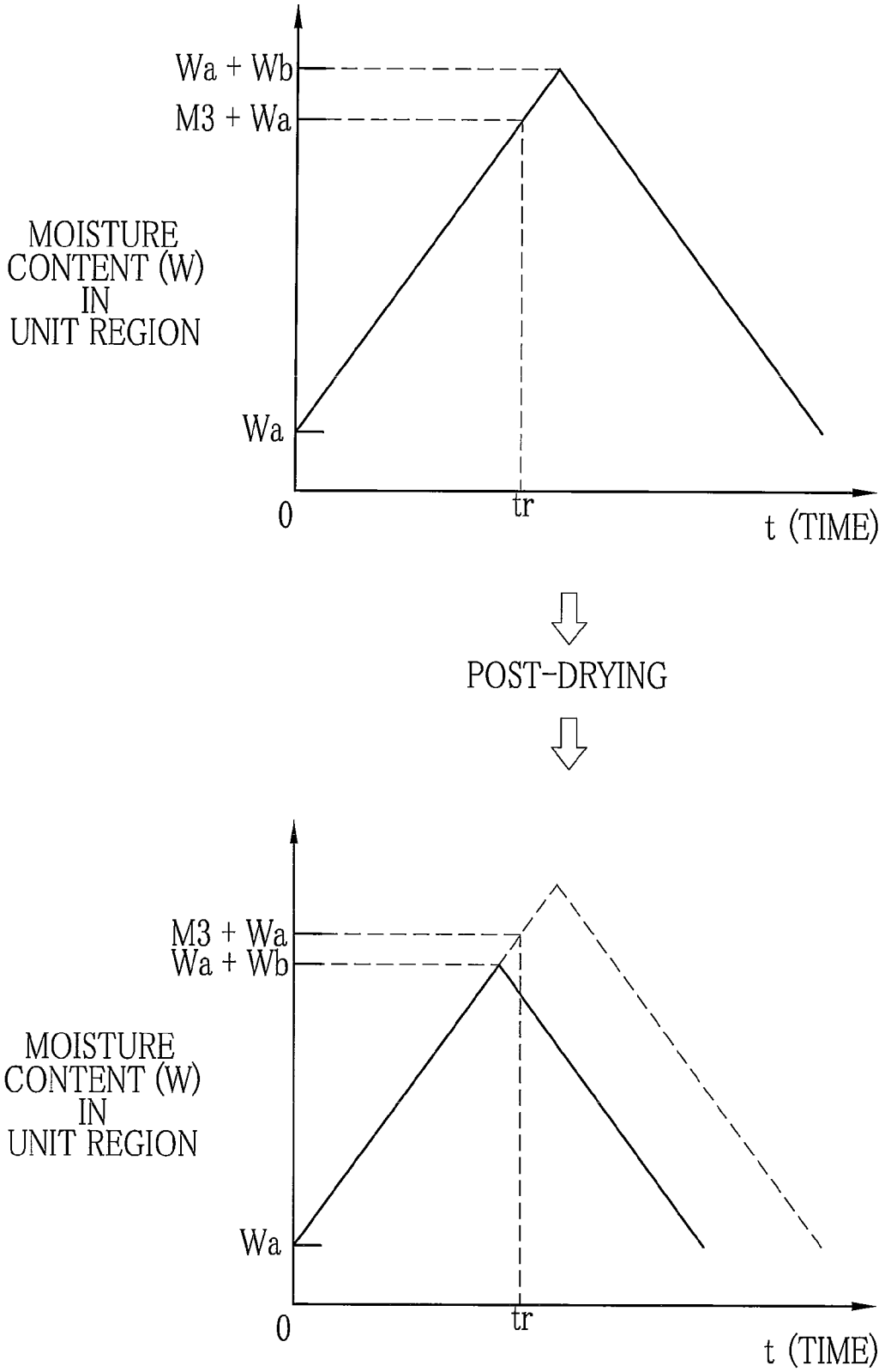
FIG. 10 is an explanatory view with combined graphs illustrating changes in a moisture content in unit regions during subsequent drying.

If M3≦Xg, the moisture content Wb (penetration amount of ink) will become higher than M3 should the ink remain without treatment. It follows that the subsequent drying is required before the penetration amount of ink becomes higher than M3. In FIG. 10, the subsequent drying is carried out before the time tr when the moisture content W in the unit region T becomes higher than M3+Wa. The second dryer 39 is disposed very close to the recording head 15 and ready for the subsequent drying before the time tr.

With reference to a lower portion of FIG. 10, the subsequent drying is carried out before the time tr. The penetration of ink is suppressed in moisture evaporation of the moisture content Wb of the ink. The moisture content W in one of the unit regions T comes up to a peak before becoming more than M3+Wa. For the drive condition of the subsequent drying, the drying temperature is stepwise determined according to a difference obtained by subtracting M3 from the dot number Xg, in a manner similar to the pre-drying. Note that it is further possible to use the highest drying temperature estimated previously for the subsequent drying, so as to render the moisture content W in the unit region T equal to or less than M3+Wa. The highest drying temperature may be preset in consideration of recording an image developable with the maximum duty of printing.

In short, the pre-drying is a sequence of moisture evaporation of the moisture content Wa in the unit regions T before the recording, to enhance an allowable range of the moisture content Wb of ink. In contrast, the subsequent drying is a sequence of forcibly evaporating water in the ink before the amount of the penetrated ink becomes higher than M3.

The drive condition determiner 70 retrieves drying temperature from the single-sided and double-sided recording data tables 81 and 82 for each one of the unit regions T in correspondence with the dot number Xg as total ink volume specified for the unit region T. Also for the double-sided recording, the drive condition determiner 70 additionally retrieves information of an enabled or disabled state of the subsequent drying. The drive condition determiner 70 generates information of a combination of the retrieved drying temperature (and an enabled or disabled state of the subsequent drying if any), and inputs the information to the CPU 60.

The CPU 60 by way of a changer controls the heater driver 71 and drives the heating elements 80 successively for the drying temperature determined by the drive condition determiner 70 and in synchronism with the moving speed of the recording medium P. Specifically, power to apply to the heating elements 80 is changed over at each time that the recording medium is moved by the length Ws of the unit region T in the sub scanning direction.

To use the ink jet printer 2 constructed above, at first the external device 65 is connected with the communication interface 61 with a communication cable or the like. A power source is turned on to power the ink jet printer 2. Data for image recording and a start signal is input to the CPU 60 by the external device 65. Then the ink jet printer 2 starts image forming on a recording medium P.

The operation of the ink jet printer 2 is hereinafter described, for each of two sequences of the single-sided recording and double-sided recording according to a command signal from the external device 65.

Figure 11:
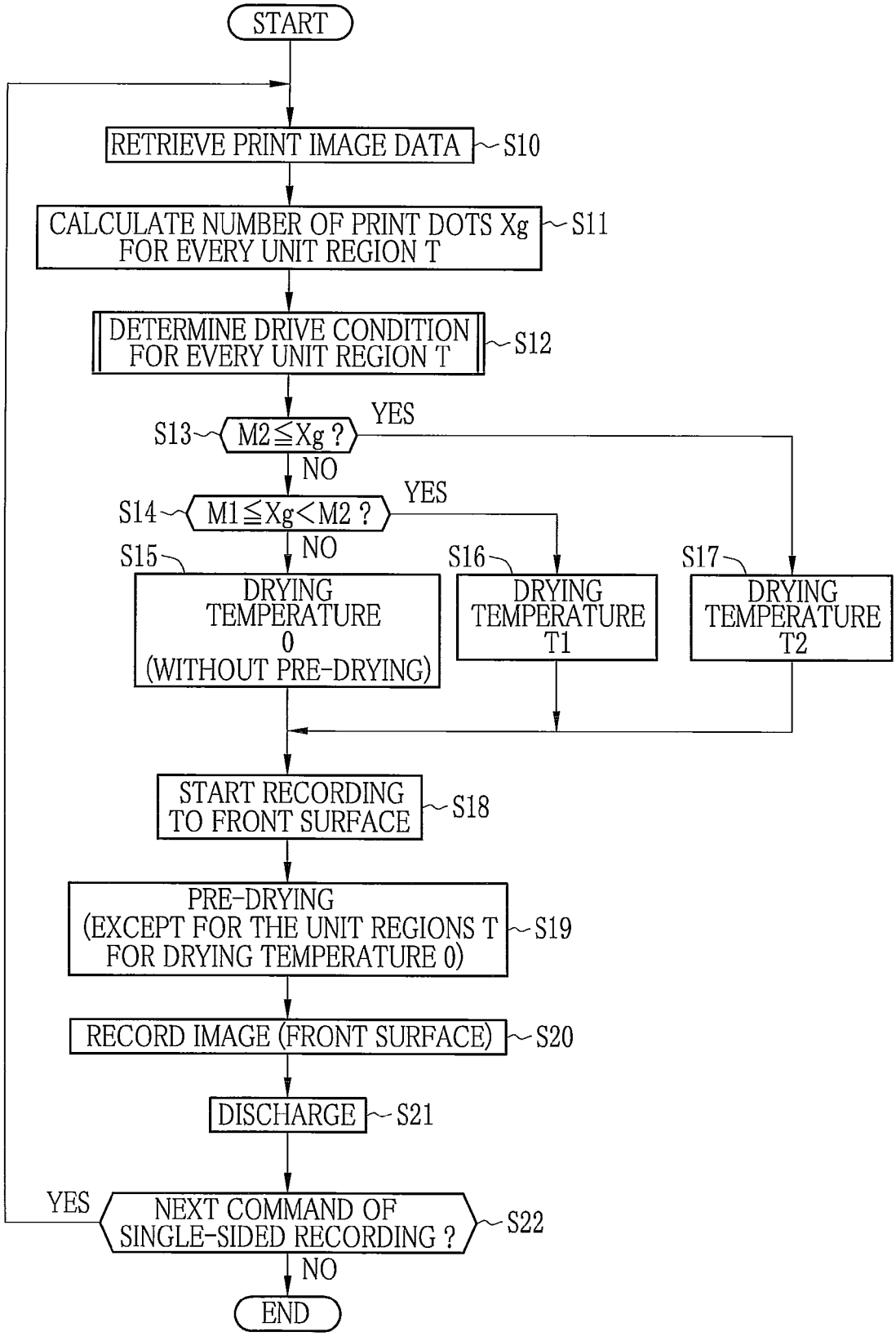
FIG. 11 is a flow chart illustrating a sequence of single-sided recording.

When the single-sided recording is instructed, at first the drive condition determiner 70 reads printing image data from the RAM 64 in the step S10 of FIG. 11. The drive condition determiner 70 determines the printing dot number Xg or dot count for each of the unit regions T or partial areas according to the printing image data in the step S1.

In the step S12, the drive condition determiner 70 determines the drive condition for the dot number Xg determined in the step S11 by referring to the single-sided recording data table 81 from the ROM 63, the drive condition being associated with each of the unit regions T.

For each one of the unit regions T, the drive condition determiner 70 sets 0 as the drying temperature if 0≦Xg<M1 (NO in the steps S13 and S14), and determines not carrying out of the pre-drying (S15). If M1≦Xg<M2 (NO in the step S13 and YES in the step S14), then the drive condition determiner 70 sets the drying temperature at T1 (S16). If M2≦Xg (YES in the step S13), then the drive condition determiner 70 sets the drying temperature at T2 (S17). Information of the drying temperature, and specific regions in the unit regions T, determined by the drive condition determiner 70, are input to the CPU 60.

After the drive condition is determined in the drive condition determiner 70, the first surface recording is started in the step S18. At first, the conveyor motor 69 drives the pickup roller 31 to rotate. An uppermost one of the recording media P on the pressure plate 13 is advanced toward the image forming device 11.

The recording medium P moved by the pickup roller 31 passes by the supply roller 33 and reaches the position of the first dryer 38. The heater driver 71 is controlled by the CPU 60 to drive the heating elements 80 successively to obtain the drying temperature determined by the drive condition determiner 70. The unused recording medium P is dried by the pre-drying in the step S19. Specifically, predetermined regions among the unit regions T designated in the step S15 for the drying temperature of 0 and the disabled state of the pre-drying are not subjected to the pre-drying. Other regions among the unit regions T designated in the step S16 for the drying temperature of T1 and designated in the step S17 for the drying temperature of T2 are dried by pre-drying suitably.

After the pre-drying, the recording medium P is moved in the downstream direction by the discharge roller 22 and the supply roller 33, while the carriage 14 is moved in the main scanning direction and ink is ejected by the recording head 15. An image is recorded on the surface of the recording medium P in the step S20. Then the recording medium P is discharged by the discharge roller 22 to a discharge tray in the step S21. The sequence of those steps is repeated if the external device 65 inputs a command signal for succeeding single-sided recording, which is indicated by YES in the step S22. In FIG. 11, the pre-drying of S19 is separated from the image forming of S20. However, the image forming is followed immediately by the pre-drying in an actual sequence. An image is recorded in successive steps to the array of the unit regions T in the main scanning direction after the pre-drying. This sequence is the same for the structure of FIG. 12.

Figure 12:
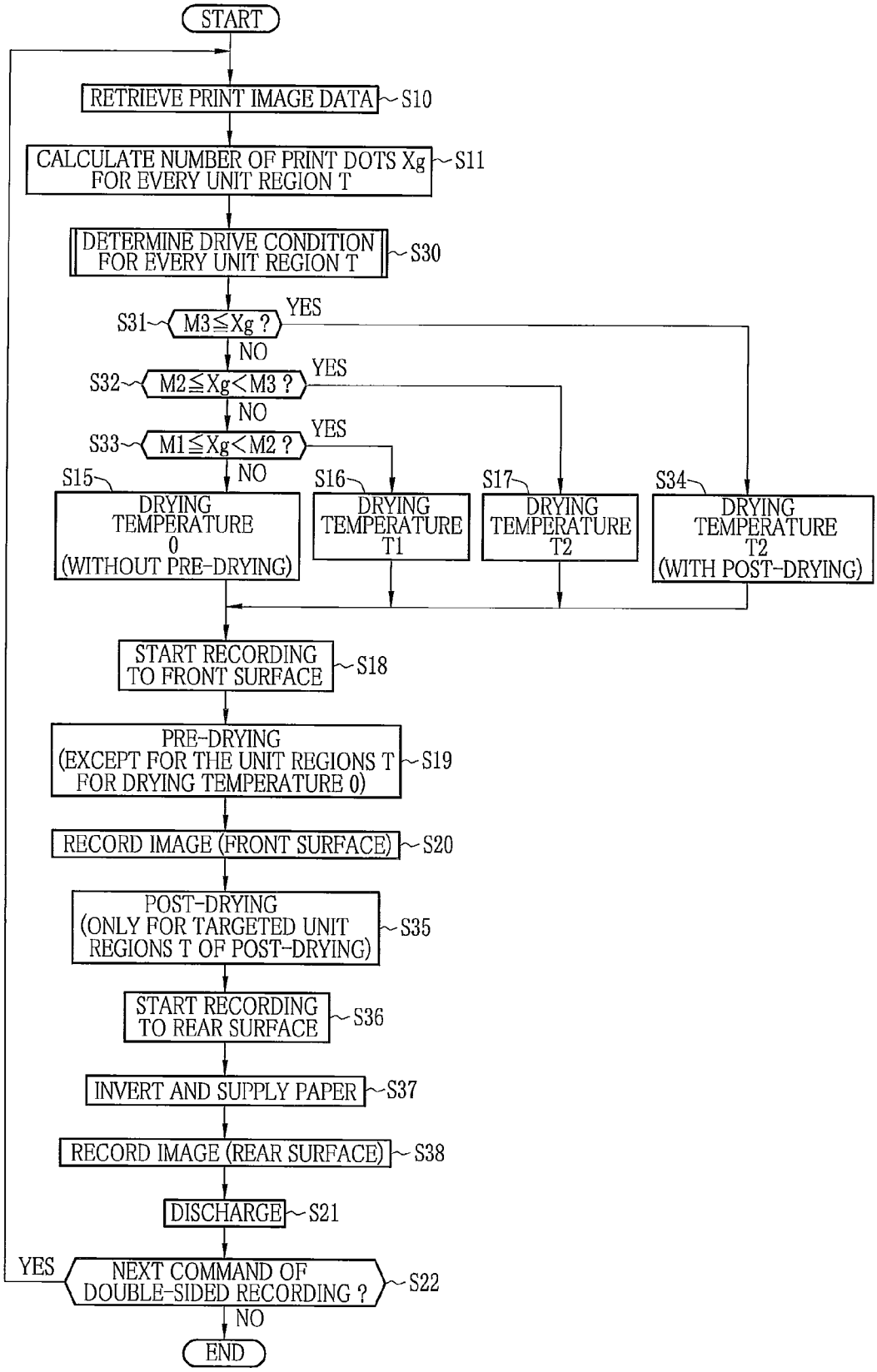
FIG. 12 is a flow chart illustrating a sequence of double-sided recording.

When a command signal for the double-sided recording is generated, the operation is FIG. 12 is carried out. Remaining parts of the sequence, which are the same as those in FIG. 11 such as S10 and S11, are omitted in the description.

In the step S30, the drive condition determiner 70 refers to the double-sided recording data table 82 read from the ROM 63, and determines a drive condition for each one of the unit regions T according to the printing dot number Xg or dot count determined in the step S11.

For each one of the unit regions T, the drive condition determiner 70 sets 0 as the drying temperature if 0≦Xg<M1 (NO in the steps S31, S32 and S33) or if M1≦Xg<M2 (NO in the steps S31 and S32 and YES in the step S33). The drive condition determiner 70 determines not carrying out of the pre-drying (S15) and sets the drying temperature at T1 (S16). This is in a manner similar to the single-sided recording. If M2≦Xg<M3 (NO in the step S31 and YES in the step S32), then the drive condition determiner 70 sets the drying temperature at T2 (S17) in a manner similar to the situation of M2≦Xg in the single-sided recording. If M3≦Xg (YES in the step S31), the drying temperature is set at T2, and the subsequent drying is enabled (S34). Information of the drying temperature, enabled state of the subsequent drying, and specific regions in the unit regions T, determined by the drive condition determiner 70, are input to the CPU 60.

After starting the first surface recording in the step S18, the pre-drying is carried out in the step S19 in a manner similar to the single-sided recording. An image is formed on the first surface of the recording medium P in the step S20. Immediately, the second dryer 39 operates for the subsequent drying in the step S35 only for regions among the unit regions T designated in the step S34 for the subsequent drying. Thus, it is possible to prevent paper cockles in the recording medium P reliably after the first surface recording by the pre-drying and the subsequent drying as required. Note that the pre-drying does not occur if the drying temperature is 0 (deg. C.) in the step S15 and if the disabled state of the pre-drying is determined for all the unit regions T in the recording medium P. Only the image forming is carried out. Note that such steps are not depicted in FIGS. 11 and 12. For the subsequent drying, the same sequence of the pre-drying is used.

When the second surface recording is started in the step S36, the discharge roller 22 and the supply roller 33 are caused by the conveyor motor 69 to rotate in the backward direction, to move the recording medium P out of the discharge tray toward the reverse feeding device 43.

The reverse feed roller 44, which is rotated in the backward direction by the conveyor motor 69, moves the recording medium P for entry in the roller assembly 46 in the reverse feeding device 43. In the roller assembly 46, the small intermediate roller 47 and the large end roller 48 rotated in the forward direction by the conveyor motor 69 directs the recording medium P into a path for reverse feeding. Thus, the recording medium P is turned over. Then in the step S37, the reverse feed roller 44 and the supply roller 33 rotating in the forward direction move the recording medium P to the position under the recording head 15, which forms an image on its second surface (S38). Those steps in the sequence are repeated if there is a command signal from the external device 65 for a succeeding double-sided recording (YES in the step S39).

As has been described heretofore, cockles can be prevented reliably because the unused recording medium P is dried in the ink jet printer 2 in a drying condition which is changed according to the total ink volume.

Owing to the pre-drying, it is possible previously to evaporate water of the moisture content Wa in the recording media P, specifically in the cellulose fiber constituting the recording media P. The first tolerable amount is set as high as M2 or M3 by a difference in the moisture content of the water evaporated in the pre-drying. It is possible to prevent swelling of the cellulose fiber before occurrence of paper cockles even though water of moisture content Wb over the first tolerable amount M1 is penetrated in the recording medium P without pre-drying.

In the pre-drying, the cellulose fiber in the recording medium P contracts to have a thinner form owing to the moisture evaporation of the moisture content Wa. The surface area of the cellulose fiber decreases. A volume of void between adjacent cellulose fibers increases. Thus, an area of contact of the penetrated ink with area increases to quicken the drying of the ink. Thus, the drying time of the ink can be shortened at the same time as cockles can be prevented. It is possible to shorten the drying time further by the step of the subsequent drying. This is typically effective in smoothing the transition from the first surface recording to the second surface recording in the operation of the double-sided recording.

Note that cockles occur in any of the unit regions T where the printing dot number Xg or dot count is equal to or more than M3 in the single-sided recording. However, no serious damage will occur in relation to the quality of a finally obtained print in the manner of the double-sided recording, because occurrence of cockles in the single-sided recording will influence only to the appearance to a small extent. Therefore, no subsequent drying is carried out in the single-sided recording in the above embodiment. Note that it is possible to carry out the subsequent drying in the single-sided recording.

In the above embodiment, the type of the recording medium P and ink is common. All of ink droplets ejected by the recording head 15 penetrate in the surface of the recording medium P. However, the first tolerable amount differs according to types of the recording medium P. Also, the moisture content Wb assigned by ink depends upon the types of the ink.

Examples of the recording media P include a first material (for example, coated paper) in which the first tolerable amount is relatively high and no cockles occur even if the total ink volume of the ink is relatively high, and a second material (for example, plain paper) in which the first tolerable amount is relatively low and cockles occur even if the total ink volume is relatively low. Examples of the ink include a first fluid containing solvent at a relatively large amount (for example, dye ink), and a second fluid containing solvent at a relatively small amount (for example, pigment ink and other types called low-penetration inks). The moisture content Wb provided by ink differs according to a solvent content of the ink, even though the total ink volume is equal. Therefore, it is preferable in the drive condition determiner 70 to determine the drive condition according to the recording medium P and types of the ink.

To this end, data tables for determining a drive condition are stored in the ROM 63 for combinations of types of the recording medium P and ink. For examples, types of the recording medium P are plain paper and coated paper. Types of the ink are dye ink and pigment ink. Then the data tables are 2×2=4 tables. Furthermore, it is possible that types of recording are the single-sided recording and double-sided recording. Then eight data tables are provided.

For a combination of the recording medium P with a relatively high value of the first tolerable amount and the ink containing solvent of a relatively great amount, the value M1 is set high, and the drying temperature is also set high. For a combination of the recording medium P with a relatively low value of the first tolerable amount and the ink containing solvent of a relatively small amount, the value M1 is set low, and the drying temperature is also set low.

Information of types of the recording medium P and ink can be retrieved by use of the communication interface 61 or the user interface 62. Also, an RFID tag can be associated with a cartridge and store information of the type of the ink. In combination, an RFID reader can read the information of the type automatically. The drive condition determiner 70 reads a data table from the ROM 63 according to the combination of the types of the recording medium P and ink, and determines the drive condition.

Furthermore, only one reference data table can be prepared and stored in place of the data tables for the combinations of types of the recording media P and ink. Correction amounts related to the reference data table are stored for the types of the recording media P and ink. It is possible to determine the drive condition by addition or subtraction of one of the correction amounts with the first tolerable amount, drying temperature or the like in the reference data table. This is effective in reliably preventing occurrence of paper cockles though the types of the recording media P and ink are numerous considerably Also, the first and second dryers 38 and 39 can be driven in a suitably adjusted drive condition, to prevent excessive use of energy.

In the above embodiment, the data table for conditioning is based on a combination of types of the recording medium P and the ink. However, a data table for conditioning may be based on any one of a type of the recording medium P and a type of the ink. Also, the drive condition may be determined according to other characteristics, such as a font size of characters to record, temperature or humidity of the inside of the ink jet printer 2, and the like.

To determine the drive condition according to the font size of characters, the drying temperature is determined equal to a reference drying temperature if the font size≦25 pt, determined +20 deg. C. higher than the reference drying temperature if 25 pt<the font size≦50 pt, and determined +40 deg. C. higher than the reference drying temperature if 50 pt<the font size. To determine the drive condition according to environmental temperature and humidity, a thermometer/hygrometer is installed in the ink jet printer 2 for measuring the temperature and humidity. If the temperature is high, for example in the summertime or directly after consecutive printing, then the drying temperature is set lower. If the humidity is high, for example in the rainy season or directly after printing of pixels of the maximum duty of printing, then the drying temperature is set higher. Furthermore, it is possible to maintain the temperature and humidity in the ink jet printer 2 constant by use of heat insulator or desiccator, to remove environmental factors from determining the drive condition.

Another preferred ink jet printing is described. Elements similar to those of the above embodiment are referred to with identical reference numerals.

In the first embodiment, the subsequent drying is carried out immediately after the recording of the first surface for the unit regions T. In contrast, the second embodiment has a feature of waiting of the recording medium P set in the discharge tray after the recording of the first surface.

Figure 13:
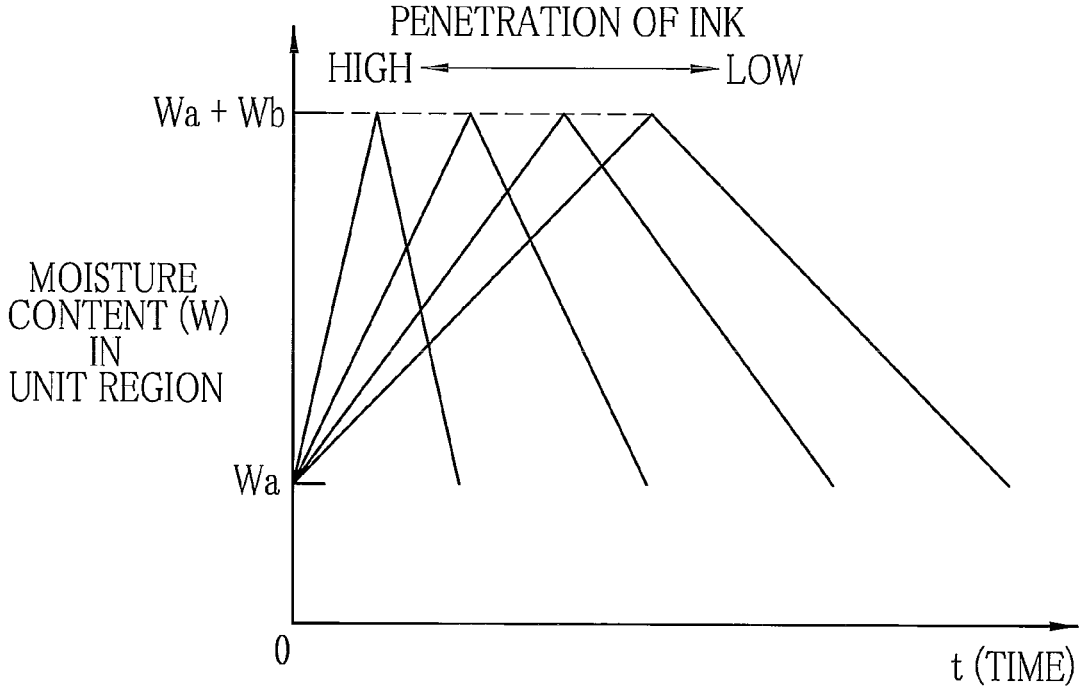
FIG. 13 is a graph illustrating a relationship between a moisture content in a unit region and time during penetration.

In the recording medium P, such as coated paper with low penetration of ink, time for penetration of ink is relatively long in the condition of an equal total ink volume and without moisture evaporation of the moisture content Wb in the atmosphere during the penetration. See FIG. 13. Thus, it is likely that only part of the ink for use can penetrate in any of the unit regions T or partial areas and that the second surface recording may start even in a moist state of the first surface of the recording medium P due to moisture of the ink. This is a problem in possible smears of residual ink on the supply roller 33 due to failure in the penetration in the unit region T.

The residual ink is penetrated in the unit region T by keeping time for the recording medium P to wait in the discharge tray. However, it is likely that the penetration amount of ink will be more than M3 if the recording medium P waits too long, as described with FIGS. 9 and 10. Therefore, the subsequent drying must be carried out before the penetration amount of ink becomes higher than M3.

Figure 14:
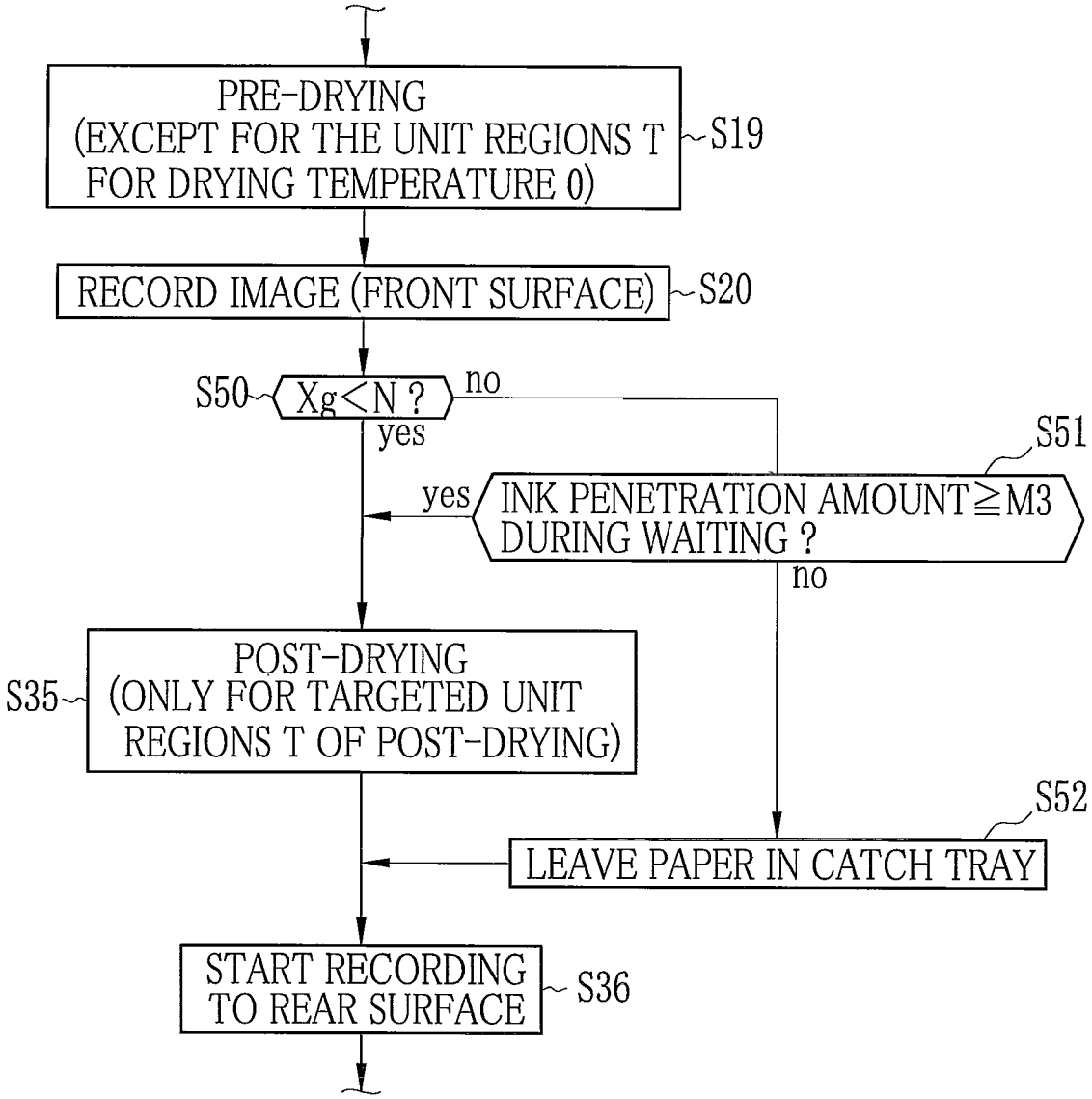
FIG. 14 is a flow chart illustrating a portion of a sequence of double-sided recording in one embodiment.

As illustrated in FIG. 14, if the printing dot number Xg or dot count (total ink volume) of all the unit regions T is lower than a second tolerable amount N in the double-sided recording (Xg<N and YES in the step S50), then the subsequent drying is started immediately (S35) without waiting of the recording medium P in the discharge tray. The second tolerable amount N is set as a value short of complete drying and fixation within predetermined time. Furthermore, if there is at least one of the unit regions T where an estimated increased level of the penetration amount of ink during waiting is M3 or more (NO in the step S50 and YES in the step 51), then the subsequent drying is started immediately (S35) without waiting of the recording medium P in the discharge tray.

If there is at least one unit region T where the dot number Xg is equal to or more than the second tolerable amount N (N≦Xg) being short of complete drying and fixation in a predetermined time (NO in S50), and if an estimated increased level of the penetration amount of ink for all of the unit regions during waiting is smaller than M3 (NO in S51), then the recording medium P waits in a discharge tray (S52).

The sequence of the second preferred embodiment is characterized in determining either one of forcible drying according to the subsequent drying and natural drying according to waiting, in consideration of comparison of the total ink volume with the second tolerable amount N, and comparison of the penetration amount of ink with M3.

The drive condition determiner 70 by way of a waiting device determines whether the recording medium P should wait in the discharge tray or not. If the drive condition determiner 70 outputs a command signal for waiting of the recording medium P in the discharge tray, the motor driver 68 is controlled by the CPU 60 to drive the conveyor motor 69. The recording medium P after the first surface recording waits in the discharge tray for a predetermined time, before recording of a second surface is started in the step S36. Thus, it is possible to prevent cockles and also smears with residual ink owing to the waiting operation of the recording medium P in the discharge tray. Note that starting and ending portions in the sequence of FIG. 12 is omitted in the sequence of FIG. 14.

A length of time for waiting of the recording medium P in the discharge tray can be constant, or changeable according to a result of comparison between the dot number Xg and a threshold value, in a manner similar to the drying temperature of the pre-drying and subsequent drying. Also, the recording medium P may be dried by the subsequent drying after waiting in the discharge tray.

In the embodiment, the number of the unit regions T where the N≦Xg is at least one as a condition for waiting of the recording medium P in the discharge tray. However, it is possible to set the recording medium P for waiting only when the number of the unit regions T where the N≦Xg is equal to or more than a predetermined reference number.

Furthermore, it is possible to allow waiting of the recording medium P in the discharge tray according to locations of specific regions among the unit regions T where N≦Xg. If such a specific region where N≦Xg is positioned downstream (located for earlier image forming) and if there remains recording time being sufficient equally with waiting of the recording medium P in the discharge tray, then the sequence continues without waiting of the recording medium P. This is followed immediately by the second surface recording, which is similar to the first embodiment.

In the embodiment, the first and second dryers 38 and 39 are separate. However, it is possible that the subsequent drying is ready to be carried out before the time tr of FIG. 10. The second dryer 39 is unnecessary if the recording medium P reaches the first dryer 38 after the first surface recording on or before the time tr.

A heater for applying heat energy to the unit regions T in the invention is not limited to the infrared heater 40. Heat energy may be applied to the second surface of the recording medium P, and also to both of the first and second surfaces. For heating the second surface, a heat source may be set directly to contact the second surface for direct heating.

Figure 15:
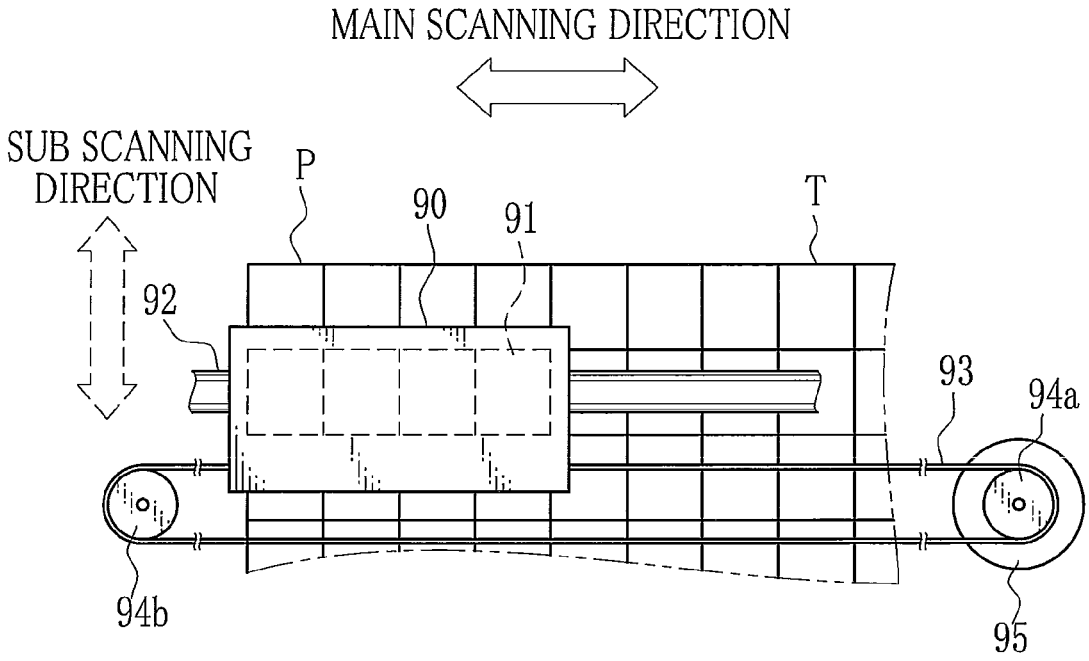
FIG. 15 is an explanatory view in a top plan illustrating a dryer of a scanning type.

In FIG. 15, another preferred infrared heater 90 is illustrated, and has a smaller number of heating elements. In the main scanning direction, four heating elements 91 are arranged. A guide shaft 92 by way of a changer extends in the main scanning direction to support the infrared heater 90 movably in the manner of the recording head 15. A drive belt 93 has one portion which drives the infrared heater 90 in engagement. A pair of pulleys 94*a* and 94*b* are arranged in the main scanning direction. The drive belt 93 extends in contact with the pulleys 94*a* and 94*b* and is caused to turn round. The pulley 94*a* is supported on an output shaft of a heater scanning motor 95. When the heater scanning motor 95 rotates, the infrared heater 90 is caused by the drive belt 93 to move back and forth in the main scanning direction.

Figure 16:
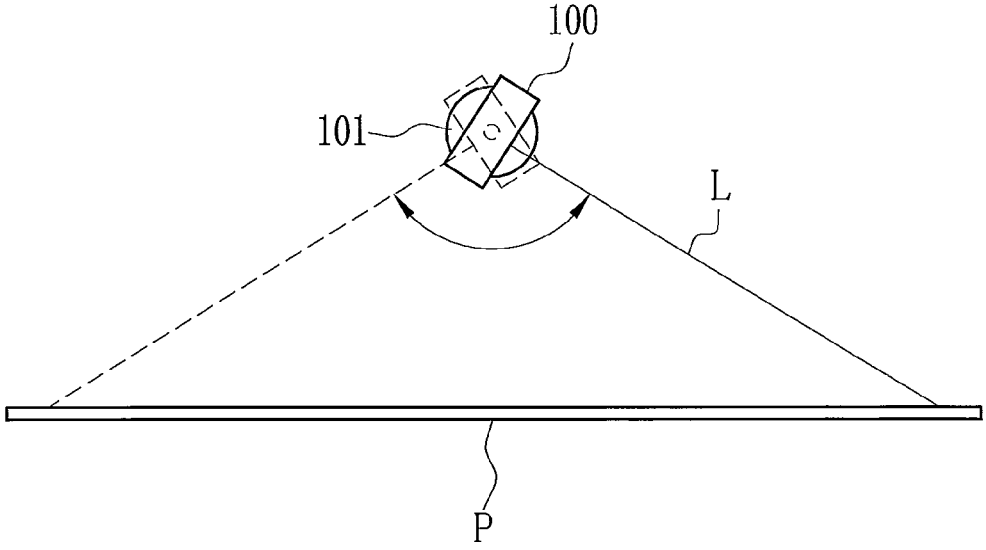
FIG. 16 is an explanatory view in a top plan illustrating a dryer of a pivotally moving type.

Also, a heat source and a fan or blower can be additionally used. Hot air may be blown by the fan to the unit regions T. The heat source may be an infrared heater, an infrared laser light source and the like. When the infrared laser light source is used, no attenuation occurs in the heat energy even with a distance of application. It is thus possible to connect a moving mechanism for swinging the infrared laser light source. In FIG. 16, a dryer including an infrared laser light source 100 is provided. A rotating mechanism 101 including a motor has a drive shaft to which the infrared laser light source 100 is secured. The infrared laser light source 100 is rotated by the rotating mechanism 101 to scan laser light L in the main scanning direction. The unit regions T are heated and dried by laser light L. It is possible to change the locations of the unit regions to be dried with the dryer by moving the recording medium P relative to the dryer.

In the above embodiment, the unit regions are shaped in a quadrilateral form. However, the unit regions or partial areas may be strip-shaped regions defined by virtually splitting with lines extending in one of the main and sub scanning directions. The entirety of the surface of the recording medium P may be one unit region. If the strip-shaped regions extend in the main scanning direction, a heat source in dryers should be shaped in a strip shape long in the main scanning direction to dry the unit regions at one time. In the above embodiment, the drying temperature is changed over in two levels of T1 and T2. However, the number of the levels of changing over the drying temperature may be three or more.

Furthermore, it is possible to adapt the method of the present invention in the forms of a computer executable program, user interface, recording medium for storing the program, and the like.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. An ink jet printer for printing an image by ejecting ink on recording medium, comprising:

an information retriever for specifying information of an ink volume of said ink for application to said recording medium;

a first dryer for drying said recording medium before applying said ink to said recording medium;

a memory for storing a relationship between said ink volume and a drive condition of said first dryer;

a drive condition determiner for determining a drive condition of said first dryer from said ink volume according to said relationship read from said memory;

a controller for controlling said first dryer in said drive condition determined by said drive condition determiner; and a second dryer for drying said recording medium wherein said drive condition determiner, if said ink volume is lower than an increased level of a first tolerable amount causing occurrence of cockle set by said first dryer, disables said second dryer, and if said ink volume is equal to or higher than said increased level of said first tolerable amount set by said first dryer, determines a drive condition of said second dryer to set a penetration amount of said ink in said recording medium equal to or lower than said increased level of said first tolerable amount.

2. An ink jet printer as defined in claim 1, wherein said memory stores said relationship for respectively a type of said recording medium or a type of said ink;

said information retriever further specifies information of said type of said recording medium or said type of said ink;

said drive condition determiner determines said drive condition according to at least one of said ink volume, said type of said recording medium, and said type of said ink.

3. An ink jet printer as defined in claim 1, wherein said drive condition determiner, if said ink volume is lower than said first tolerable amount on said recording medium, disables said first dryer, and if said ink volume is equal to or higher than said first tolerable amount, determines said drive condition of said first dryer to set said first tolerable amount equal to or more than said ink volume.

4. An ink jet printer as defined in claim 3, further comprising:

a structure for image forming on first and second surfaces of said recording medium in double-sided recording; wherein said second dryer for drying said recording medium is accomplished before second surface recording of said second surface after first surface recording of said first surface; and said drive condition determiner and said controller further operate for determining a drive condition of said second dryer and for control thereof.

5. An ink jet printer as defined in claim 4, further comprising a waiting device for waiting of said recording medium after said first surface recording before said second surface recording;

wherein said drive condition determiner and said controller further operate for determining a drive condition of said waiting device and for control thereof.

6. An ink jet printer as defined in claim 5, wherein if said ink volume is lower than a second tolerable amount short of sufficient drying within a predetermined time, or if an estimated value of a penetration amount of said ink in said recording medium during waiting is found to become equal to or higher than an increased level of said first tolerable amount set by said first dryer, then said drive condition determiner determines a drive condition of said second dryer to set said penetration amount equal to or lower than said increased level of said first tolerable amount without driving said waiting device;

if said ink volume is equal to or higher than said second tolerable amount, and if said estimated value of said penetration amount during waiting is found to become lower than said increased level of said first tolerable amount set by said first dryer, then said drive condition determiner determines a drive condition of said waiting device to set said penetration amount lower than said second tolerable amount.

7. An ink jet printer as defined in claim 1, wherein said information retriever specifies information of said ink volume for unit regions defined by splitting a frame on said recording medium, and said drive condition determiner determines said drive condition for each of said unit regions.

8. An ink jet printer as defined in claim 7, wherein said unit regions are arranged two-dimensionally with reference to a main scanning direction and a sub scanning direction of image forming.

9. An ink jet printer as defined in claim 8, wherein said first dryer includes plural heating elements having a size substantially equal to a size of said unit regions, arranged in said main scanning direction, and conditioned discretely in said drive condition.

10. An ink jet printer as defined in claim 7, further comprising a changer for changing a unit region designated for drying with said first dryer among said unit regions.

11. An ink jet printer as defined in claim 10, wherein said changer shifts said first dryer in a main scanning direction.

12. An ink jet printer as defined in claim 10, wherein said changer is a mechanism for rotationally shifting said first dryer to change said unit region designated for drying.

13. An ink jet printing method of printing an image by ejecting ink on recording medium, comprising steps of:

specifying information of an ink volume of said ink for application to said recording medium;

determining a drive condition of a first dryer from said ink volume according to a relationship between said ink volume and a drive condition of said first dryer;

in a first drying step, drying said recording medium in said first dryer before applying said ink to said recording medium in said drive condition determined by said drive condition determining step; and a second drying step of drying said recording medium in a second dryer, wherein if said ink volume is lower than an increased level of a first tolerable amount causing occurrence of cockle set by said first drying step, said second drying step is suppressed, and if said ink volume is equal to or higher than said increased level of said first tolerable amount set by said first drying step, said second drying step is carried out to set a penetration amount of said ink in said recording medium equal to or lower than said increased level of said first tolerable amount.

14. An ink jet printing method as defined in claim 13, wherein if said ink volume is lower than said first tolerable amount on said recording medium, said first drying step is suppressed;

if said ink volume is equal to or higher than said first tolerable amount, said first drying step is carried out and sets said first tolerable amount equal to or higher than said ink volume.

15. An ink jet printing method as defined in claim 14, wherein said second drying step of drying said recording medium in a second dryer is accomplished before second surface recording to a second surface in a sequence of double-sided recording of successive image forming to a first surface and said second surface.

16. An ink jet printing method as defined in claim 15, further comprising a step of waiting of said recording medium before said second surface recording to dry said ink on said first surface.

17. An ink jet printing method as defined in claim 16, wherein if said ink volume is lower than a second tolerable amount short of sufficient drying within a predetermined time, or if an estimated value of a penetration amount of said ink in said recording medium during waiting is found to become equal to or higher than an increased level of said first tolerable amount set by said first drying step, then said second drying step is carried out to set said penetration amount equal to or lower than said increased level of said first tolerable amount by suppression of said waiting step;

if said ink volume is equal to or higher than said second tolerable amount, and if said estimated value of said penetration amount during waiting is found to become lower than said increased level of said first tolerable amount set by said first drying step, then said waiting step is carried out to set said penetration amount lower than said increased level of said second tolerable amount.

* * * * *